US005523195A

United States Patent [19]

Darmon et al.

[11] Patent Number: 5,523,195

[45] Date of Patent: Jun. 4, 1996

[54] PHOTOGRAPHIC CONDITIONING SOLUTION CONTAINING BLEACH ACCELERATOR, FORMALDEHYDE PRECURSOR AND SECONDARY AMINE AND METHOD OF USE

[75] Inventors: Charles M. Darmon, Spencerport; Michael P. Youngblood, Rochester; Rosa P. Sauter, Spencerport, all of N.Y.

[73] Assignee: Eastman Kodak Company, Rochester, N.Y.

[21] Appl. No.: 393,293

[22] Filed: Feb. 23, 1995

[51] Int. Cl.[6] ..... G03C 11/00; G03C 7/00; G03C 5/18; G03C 7/46

[52] U.S. Cl. ..... 430/393; 430/372; 430/379; 430/387; 430/407; 430/427; 430/428; 430/429; 430/432; 430/463

[58] Field of Search ..... 430/372, 379, 430/407, 427, 428, 429, 432, 463

[56] References Cited

U.S. PATENT DOCUMENTS

| | | | |
|---|---|---|---|
| 4,786,583 | 11/1988 | Schwartz | 430/372 |
| 4,921,779 | 5/1990 | Cullinan et al. | 430/379 |
| 4,960,682 | 10/1990 | Cullinan et al. | 430/393 |
| 4,975,356 | 12/1990 | Cullinan et al. | 430/393 |
| 5,037,725 | 8/1991 | Cullinan et al. | 430/372 |
| 5,110,716 | 5/1992 | Kuse et al. | 430/428 |
| 5,217,852 | 6/1993 | Morigaki et al. | 430/428 |
| 5,334,493 | 8/1994 | Fujita et al. | 430/463 |
| 5,348,845 | 9/1994 | Morigaki et al. | 430/428 |
| 5,441,851 | 8/1995 | Singer et al. | 430/372 |
| 5,441,852 | 8/1995 | Hagiwara et al. | 430/429 |
| 5,449,593 | 9/1995 | Morigaki et al. | 430/429 |

FOREIGN PATENT DOCUMENTS

| | | | |
|---|---|---|---|
| 4-214556 | 8/1992 | Japan | 430/428 |

*Primary Examiner*—Charles L. Bowers, Jr.
*Assistant Examiner*—J. Pasterczyk
*Attorney, Agent, or Firm*—J. Lanny Tucker

[57] ABSTRACT

A conditioning or bleach accelerating solution can be used to process color photographic films, especially color reversal films, to minimize magenta dye fade while reducing the needed amount of formaldehyde stabilizer. These advantageous effects are achieved by including a secondary amine in the solution along with a formaldehyde precursor and a bleach accelerator.

20 Claims, No Drawings

PHOTOGRAPHIC CONDITIONING SOLUTION CONTAINING BLEACH ACCELERATOR, FORMALDEHYDE PRECURSOR AND SECONDARY AMINE AND METHOD OF USE

FIELD OF THE INVENTION

This invention relates in general to color photography and in particular to methods and compositions useful in the processing of color photographic materials, especially color reversal photographic elements. More particularly, this invention relates to an improved pre-bleach stabilizing solution, and its use in the processing of the noted materials.

BACKGROUND OF THE INVENTION

Multicolor, multilayer photographic elements are well known in the art. Such materials generally have three different selectively sensitized silver halide emulsion layers coated on one side of a single support. Each layer has components useful for forming a particular color in an image. Typically, they utilize color forming couplers that form yellow, magenta and cyan dyes in the sensitized layers during processing.

After color development, it is necessary to remove the silver image that is formed coincident with the dye image. This can be done by oxidizing the silver using a suitable oxidizing agent, commonly referred to as a bleaching agent, in the presence of a halide, followed by dissolving the silver halide so formed using what is known as a fixing agent. In some instances, the bleaching and fixing steps are combined into a single bleach-fixing step.

A commercially important process intended for use with color reversal photographic elements that contain color couplers in the emulsion layers, or layers contiguous thereto, uses the following sequence of processing steps: first developing, washing, reversal bath, color developing, bleaching, fixing, washing and stabilizing.

In such photographic processes, a bleach-accelerator bath is often used between the color developing and bleaching steps. The bleach-accelerator bath is also known as a "conditioning" bath or solution. It is used to "condition" the metallic silver developed in the two developing steps, for complete oxidation to silver halide and to help preserve the acidity of the bleaching solution by reducing carryover of color developer into the bleaching solution. The conditioning solution contains, as an essential component, an effective amount of a bleach-accelerating agent. This agent is imbibed into the emulsion layers of the photographic element during treatment with the conditioning bath, and is accordingly present to exert its intended effect when the element is put into the bleaching solution.

Magenta dye instability is a particularly undesirable problem in color photography, as the magenta dye image may fade more rapidly than either the cyan or yellow dye images. This is particularly evident when arylpyrazolone type magenta dye forming color couplers are used. Thus, considerable effort has been exerted to find solutions to this problem, including the use of dye stabilizers in stabilization baths at the end of the processing method, as described in U.S. Pat. No. 4,786,583 (Schwartz).

It is also known from U.S. Pat. No. 4,921,779 (Cullinan et al), U.S. Pat. No. 4,975,356 (Cullinan et al) and U.S. Pat. No. 5,037,725 (Cullinan et al) that formaldehyde precursors can be incorporated into conditioning solutions to further improve magenta dye stability. These patents describe a number of formaldehyde precursors for this purpose including sodium formaldehyde bisulfite, hexamethylenetetramine and various methylol compounds.

U.S. Pat. No. 5,334,493 (Fujita et al) describes the use of a combination of formaldehyde and a secondary amine to allegedly stabilize magenta dyes in the processing of photographic elements. The combined materials can be included in any of a variety of processing solutions including "final" stabilizing solutions. It would be desirable, however, to avoid the use of formaldehyde entirely since it is an environmental and potentially health hazard.

For some time, conditioning solutions for color reversal film processing have been used which contain relatively high concentrations of sodium formaldehyde bisulfite (for example, over 40 g/l and as much as 55 g/l). This effectively solves the magenta dye instability problem but there is a growing concern about the potential health hazards from exposure to formaldehyde during photofinishing. Various governmental regulations are requiring less exposure to formaldehyde.

Thus, there is a need for a conditioning solution containing reduced amounts of formaldehyde precursor, but which still provides magenta dye stability.

SUMMARY OF THE INVENTION

The problems noted with known conditioning solutions and processing methods have been overcome using a method for processing a color silver halide photographic element comprising:

A) treating an imagewise exposed and developed color silver halide photographic element with a conditioning solution comprising a bleach accelerating agent, a formaldehyde precursor at a concentration of less than 30 g/l, and a secondary amine, and B) bleaching the element treated in step A.

This invention also provides a conditioning solution having a pH of from about 4.5 to about 8, and comprising a bleach accelerating agent, a formaldehyde precursor at a concentration of less than 30 g/l, and a secondary amine.

The present invention effectively provides a solution to the magenta dye instability problem for processing color photographic reversal films. Moreover, the amount of exposure to potentially harmful formaldehyde is lessened considerably relative to the exposure likely during conventional processing. This is accomplished by significantly reducing the amount of formaldehyde precursor included in the conditioning solution from that normally used. In order to make this reduction, however, it has been found that a secondary amine must be included in the solution.

DETAILED DESCRIPTION OF THE INVENTION

A wide variety of photographic elements can be used in the practice of the present invention. A detailed description of such materials is found, for example, in Research Disclosure, publication 36544, pages 501–541 (September, 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". More details about such elements are provided herein below.

Color reversal photographic elements utilized in the practice of this invention are comprised of a support having on one side thereof a plurality of photosensitive silver halide emulsion layers. The photosensitive layers can contain any of the conventional silver halides as the photosensitive material, for example, silver chloride, silver bromide, silver bromoiodide, silver chlorobromide, silver chloroiodide, silver chlorobromoiodide, and mixtures thereof. Useful support materials include cellulose acetate film, polyvinylacetal film, polycarbonate film, polystyrene film, polyethylene terephthalate film, and the like. The silver halide is dispersed within a suitable hydrophilic colloid such as gelatin or derivatives thereof. The silver halide emulsion layers can contain a variety of well-known addenda, including but not limited to, chemical sensitizers, development modifiers and antifoggants.

As explained above, a well-known color reversal process of the prior art utilizes a first developer, a reversal bath, a color developer, a conditioning solution, a bleach bath, a fixing bath and a stabilizer bath. The components that are useful in each of such baths are well known in the photographic art. The improved process of this invention can utilize the same baths except that the stabilizer bath is not needed, that is, the final bath can be a rinse or wash bath consisting of water, or preferably an aqueous solution containing a sufficient amount of a surfactant to prevent spotting of the photographic film. Thus, in the present invention, the secondary amine and formaldehyde precusor are used in a separate conditioning step, and are not used in the conventional bleaching, fixing or bleach/fixing steps. Thus, the conditioning solution does not contain the compounds conventionally used as bleaching or fixing agents.

The first developer generally contains a black-and-white developing agent or a mixture thereof. Useful developing agents include, but are not limited to, dihydroxybenzene developing agents (such as hydroquinone), 3-pyrazolidone developing agents (such as 1-phenyl-3-pyrazolidone), and aminophenol developing agents (such as paraaminophenol). In addition to the developing agent, the first developer typically contains other agents such as preservatives, sequestering agents, restrainers, antifoggants, buffers and silver halide solvents.

The reversal bath generally contains a nucleating agent, such as a boron compound or a chelated stannous salt that functions as a reducing agent, as well as antioxidants, buffers, fungicides and sequestering agents.

In addition to an aromatic primary amino color developing agent, the color developing bath typically contains sequestering agents, buffering agents, preservatives, competing couplers and silver halide solvents.

Particularly useful aromatic primary amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include, but are not limited to, N,N-diethyl-p-phenylenediamine monohydrochloride, 4-N,N-diethyl-2-methylphenylenediamine monohydrochloride, 4-(N-ethyl-N-2-methanesulfonylaminoethyl)-2-methylphenylenediamine sesquisulfate monohydrate, 4-(N-ethyl-N- 2-hydroxyethyl)-2-methyl-phenylenediamine sulfate, 4-N,N-diethyl-2,2'-methanesulfonylaminoethyl-phenylenediamine hydrochloride, and others readily apparent to a skilled worker in the art.

The essential component of the bleaching bath is a bleaching agent that converts metallic silver to silver ions. Other common components of the bleaching bath include halides, sequestering agents and corrosion inhibitors. Ammonium or alkali metal salts of a ferric complex of an aminopolycarboxylic acid are particularly useful as bleaching agents but other metal complexes are known in the art, including binary and ternary complexes. Also of particular utility are the persulfate bleaching agents such as ammonium or alkali metal persulfates and peroxide bleaching agents. Bleaching agents can be used individually or in the form of mixtures of two or more bleaching agents.

The fixing bath converts all silver halide into soluble silver complexes that diffuse out of the emulsion layers. Fixing bath retained within the layers of the photographic element is removed in a subsequent water washing step. Thiosulfates, including ammonium thiosulfate and alkali metal thiosulfates (such as sodium thiosulfate and potassium thiosulfate), are particularly useful as fixing agents. Other components of the fixing bath include preservatives and sequestering agents.

A wide variety of different color reversal processes are well known in the art. For example, a single color developing step can be used when the coupling agents are incorporated in the photographic element or three separate color developing steps can be used in which coupling agents are included in the developing solutions. The reversal step can be carried out by use of a reversal bath, by a re-exposure step, or by incorporating a fogging agent in the color developing bath. In order to provide shorter processing times, bleaching and fixing can be combined in a single step (known as a bleach-fixing step).

The present invention is particularly concerned with enhancing dye stability through the use of an improved bleach-accelerating (or conditioning) solution that contains a bleach accelerating agent, a formaldehyde precursor and a secondary amine. In addition to these components, the conditioning solution typically contains a preservative (for example, an alkali metal sulfite), and a sequestering agent (for example, ethylenediaminetetraacetic acid), which prevents the formation of iron stain in the emulsion layers. It may also contain an agent that alleviates the problem of scum formation.

The conditioning solutions of this invention typically have a pH in the range of from about 4.5 to about 8. Preferably, the pH is from about 4.5 to about 6.5. They contain a bleach-accelerating agent that is typically present in an amount of from about 0.1 to about 20 grams per liter of solution and more preferably in an amount of from about 0.4 to about 2 grams per liter.

Sulfur-containing organic compounds are most commonly used as bleach-accelerating agents in conditioning solutions in photographic processing. However, other types of compounds are also known, including polyalkylene oxides, organic amines, onium compounds, and n-hexoxyethanol. More details of these and the commonly used sulfur-containing compounds are provided in U.S. Pat. No. 4,921,779 (noted above) which patent is incorporated herein by reference, and references cited therein. A mixture of bleach-accelerating agents can be used if desired.

Preferred bleach-accelerating agents include but are not limited to, heterocyclic thiols such as amino-thiadiazolethiol, mercaptotriazole, imidazolethiol and aminomercaptotriazole, disulfides [such as bis(2-aminoethane)disulfide, thioglycerol disulfide and bis(N,N-dimethyl-2aminoethane)disulfide] and thioethers (such as dithiaoctanediol and thiadiethanol). Especially preferred are aliphatic thiols of the formula (I):

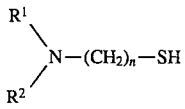

wherein each of $R^1$ and $R^2$ is H, methyl or ethyl and n is an integer having a value of from 1 to 3. Specific examples-of such aliphatic thiols include 2-aminoethanethiol, 3-aminopropanethiol, dimethylaminoethanethiol, N-methyl-N-ethyl-aminoethanethiol and diethylaminoethanethiol.

The most preferred bleach-accelerating agent for the purpose of this invention is monothioglycerol.

Also included in the conditioning solution of this invention are one or more formaldehyde precursors.

By the term "formaldehyde percursor" is meant any compound capable of establishing, in the conditioning solution, an equilibrium relationship between it and formaldehyde. While not being certain of the mechanism, it is believed that the precursor acts, in effect, as a formaldehyde donor which gradually releases formaldehyde into the solution at the same rate as it is used up in the dye-stabilizing reaction to thereby maintain the equilibrium relationship. Thus, the concentration of formaldehyde in the bleach-accelerating solution is always at a very low level and there is not enough formaldehyde in the solution to result in a buildup or undesirably high concentrations in the air above the solution.

Formaldehyde precursors that are useful for the purpose of this invention include but are not limited to the water-soluble N-methylol compounds. As used herein, the term "N-methylol compound" refers to a compound having at least one methylol group attached directly to a nitrogen atom. Particularly useful are N-methylol compounds represented by formulae I, II or III in U.S. Pat. No. 4,921,779 (noted above).

Illustrative N-methylol compounds include: dimethylol urea, trimethylol urea, dimethylol guanidine, trimethylol melamine, tetramethylol melamine, pentamethylol melamine, and hexamethylol melamine.

Another particularly preferred N-methylol compound is 1,3-dimethylol-5,5-dimethyl hydantoin.

In addition to the N-methylol compounds, examples of especially effective formaldehyde precursors include sodium formaldehyde bisulfite and hexamethylenetetramine.

A third essential component of the conditioning solution of this invention is a secondary amine compound (identified herein as a "secondary amine") which provides enhanced water solubility and has at least one secondary amine moiety in a linear or cyclic portion of the molecule. By "secondary amine moiety" is meant a moiety such as —NH—. It is not meant to include a $—NH_2$ moiety. The secondary amine useful herein has at least one secondary amine moiety, and may have up to 3 of such groups in the molecule. A plurality of secondary amines can be used if desired, but preferably only one such compound is used in the conditioning solution of this invention.

The secondary amines can be linear or cyclic. Linear compounds include, but are not limited to those represented by the following formula (II):

$$R^3—NH—R^4$$

wherein $R^3$ and $R^4$ are independently a substituted or unsubstituted alkyl group of 1 to 10 carbon atoms (such as methyl, ethyl, iso-propyl, t-butyl, n-hexyl, decyl, benzyl, 2-hydroxyethyl, p-methoxybenzyl, 2-ethyl, 2-carboxyethyl, n-butyl, sec-butyl and isobutyl), a substitutted or unsubstituted cycloalkyl having 5 to 10 carbon atoms (such as cyclopentyl, cyclohexyl, 2,4-dimethylcyclohexyl, 4-hydroxycyclohexyl, 4-ethoxycyclohexyl, 4-hydroxyethylcyclohexyl and 4-carboxycyclohexyl), a substituted or unsubstituted aryl having 6 to 10 carbon atoms (such as phenyl, p-methoxyphenyl, m-hydroxyphenyl, naphthyl, xylyl, tolyl, m-chlorophenyl, p-chlorophenyl, 3,5-dimethylphenyl and 3-carboxyphenyl), or a substituted or unsubstituted 5- to 10-membered heterocyclic group having one or more heteroatoms (sulfur, oxygen or nitrogen) in the ring and wherein the secondary amine nitrogen is attached to a carbon atom in the ring (such as 2-pyridyl, 2-pyrimidyl, 2-furanyl, 2-piperazinyl, 2-piperidinyl, 2-morpholyl, 2-pyrrolidyl, 4-pyridyl, 3-furanyl, 2-indolyl and 3-pyrazolyl).

Alternatively, $R^3$ and $R^4$ can together represent the carbon and heteroatoms (sulfur, oxygen and nitrogen) needed to complete, with the secondary amine moiety, a substituted or unsubstituted 5- to 14-membered heterocyclic ring system (including fused ring systems). Such heterocyclic compounds include, but are not limited to, morpholine, piperidine, piperazine, pyrrolidine, imidazole, 1,4-dihydropyridine and 3-pyrroline.

$R^3$ and $R^4$ of the linear compounds and the cyclic compounds just described can be substituted with one or more of a considerable number of substituents, including but not limited to, alkyl of 1 to 4 carbon atoms (linear or branched), alkoxy of 1 to 4 carbon atoms (linear or branched), hydroxy, alkenyl of 2 to 5 carbon atoms (linear or branched), phenyl, halo (such as chloro or bromo), cyano, sulfo, carboxy, phospho, sulfonyl, nitro, alkoxycarbonyl of 2 to 5 carbon atoms, carbamoyl, sulfamoyl, amino, acyl, sulfinyl, acyloxy, and other readily apparent to one skilled in the art.

Preferred secondary amines useful in the present invention are those wherein $R^3$ and $R^4$ are the same or different substituted or unsubstituted alkyl of 1 to 6 carbon atoms, or wherein $R^3$ and $R^4$ form, with the secondary amine moiety, a 5- to 6-membered heterocyclic ring.

More preferably, the secondary amines are either dialkanolamines or the noted 6-membered heterocyclic rings having at least one secondary amino moiety in the ring.

Representative secondary amines include, but are not limited to, diethanolamine, diisopropanolamine, N-methyl-N-ethylamine, N-hydroxyethyl-N-benzylamine, N-methyl -N-phenylamine, N,N-bis (hydroxyethyl) amine, pyrrolidine, imidazole, 1,4-dihydropyridine, 3-pyrroline, morpholine, piperidine and piperazine.

Preferred compounds include the dialkanolamines such as diethanolamine, and various 6-membered heterocyclic compounds such as morpholine, piperidine and piperazine. Of these, diethanolamine, morpholine and piperidine are more preferred, and diethanolamine is most preferred.

The amount of formaldehyde precursor in the conditioning solution is generally less than about 30 g/l, and amounts less than about 20 g/l are preferred with a minimum amount being about 5 g/l. More preferably, less than 15 g/l is used.

The optimum amounts of conditioning solution components can be readily determined by a skilled worker by adjusting the amount of formaldehyde precursor and secondary amine (described below) in such a manner that the magenta dye loss would be the same as or less than the dye loss observed under optimal "conventional" conditions. These conditions include processing an imagewise exposed and developed conventional color reversal photographic element (such as conventional Film Code 6121) with a conventional conditioning solution containing formaldehyde precursor at 55 g/l and no secondary amine using the processing conditions of 35° C. for 120 seconds, and including the conventional first developing, color developing, bleaching, fixing and washing steps described above. This processed element is then subjected to dye stability evaluation at 77° C. and 0% relative humidity for 7 days in an accelerated keeping test.

In a general sense, the amount of secondary amine used in the practice of this invention is at least about 0.05 g/l, with amounts of from about 0.1 to about 1.5 g/l being preferred, and from about 0.5 to about 1.2 g/l being more preferred. As noted above, the optimum amount will depend upon the amount and type of formaldehyde precursor and secondary amine used in a given solution.

Unlike what is described in U.S. Pat. No. 5,334,493 (noted above), the amount of secondary amine used in the present invention is the same as or less than (preferably, considerably less than) the amount of formaldehyde precursor. In most cases, the formaldehyde precursor will be present in an amount of 1 or more times the secondary amine (that is, a weight ratio of at least 1:1). The secondary amine is used in the present invention to catalyze the condensation chemistry of color couplers as opposed to reaction with formaldehyde to form an adduct.

The conditioning solution of this invention can also include various addenda commonly included in such solutions, as described in the Cullinan et al patent noted above, including, but not limited to, anti-scumming agents, surfactants, biocides, metal sequestrants, buffers and antioxidants.

The conditioning solution described above can be supplied in a concentrated form. Thus, the amounts for the various components noted above will be greater in the concentrate. Generally, such concentrate is diluted 4:1 to provide a solution having the noted working strength.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerably more details of the element structure and components, and suitable methods of processing various types of elements are described in *Research Disclosure,* noted above. All types of emulsions can be used in the elements, including but not limited to, thin tabular grain emulsions, and either positive-working or negative-working emulsions.

The present invention is particularly useful to process imagewise exposed and developed photographic elements containing arylpyrazolone type magenta dye forming color couplers. Such color couplers are well known in the art. One such compound is described in U.S. Pat. No. 5,037,725 (noted above).

The elements are typically exposed to suitable radiation to form a latent image and then processed as described above to form a visible dye image.

The conditioning step described above is generally carried out for less than 5 minutes, but longer times can be used if desired. Preferably, the conditioning time is from about 0.5 to about 2 minutes. The temperature at which the conditioning step is carried out is generally at or above room temperature, for example from about 20° to about 40° C.

Processing according to the present invention can be carried out using conventional deep tanks holding processing solutions. Alternatively, it can be carried out using what is known in the art as "low volume thin tank" processing systems having either rack and tank or automatic tray designs. Such processing methods and equipment are described, for example, in recently allowed U.S. Ser. No. 08/221,711 (filed Mar. 31, 1994, by Carli et al) and publications cited therein.

As used herein to define amounts and times, "about" refers to ±10% of the indicated value. In reference to temperatures, "about" refers to ±5° C. In defining pH, "about" refers to ±0.5 pH unit.

The following examples are provided for illustrative purposes only and are not intended to be limiting in any way. Unless otherwise indicated, all percentages are by weight.

Example 1

Preferred Conditioning Solution

A preferred conditioning solution of this invention was prepared by mixing the following in water (up to 1 liter): sodium formaldehyde bisulfite (15 g), diethanolamine (1 g), thioglycerol (0.4 g), potassium sulfite (45%, 10 g), succinic acid (4 g) and ethylenediaminetetraacetic acid (1 g). The pH was 5–6.5.

Examples 2–3

Alternative Conditioning Solutions

Two other conditioning solutions were prepared containing different secondary amines.

In Example 2, the solution contained the following: morpholine (1 g), sodium formaldehyde bisulfite (15 g), thioglycerol (0.4 g), potassium sulfite (45%, 10 g) and ethylenediaminetetraacetic acid (1 g). The pH was 6.25.

In Example 3, the solution contained the following: piperidine (1 g), sodium formaldehyde bisulfite (15 g), thioglycerol (0.4 g), potassium sulfite (45%, 10 g) and ethylenediaminetetraacetic acid (1 g). The pH was 6.25.

Example 4

Processing With Conditioning Solutions

The conditioning solutions of this invention were evaluated in comparison with the conventional conditioning solution of the art.

The conditioning solutions of Examples 1–3 and Control solutions were evaluated by using them to process samples of a conventional color reversal photographic film (Film Code 6121 available from Eastman Kodak Company) using the following processing protocol. This film contained a conventional 1-aryl- 5-pyrazolone magenta color coupler in one of the emulsion layers.

| Processing Protocol: | |
|---|---|
| 6 minutes | First Development* |
| 2 minutes | Water wash |
| 2 minutes | Reversal bath** |

-continued

| Processing Protocol: | |
|---|---|
| 6 minutes | Color development*** |
| 2 minutes | Conditioning |
| 6 minutes | Bleaching**** |
| 4 minutes | Fixing# |
| 4 minutes | Water wash |
| 30 seconds | Final wash## |
| 20 minutes | Drying |

*Using conventional Process E-6 KODAK ™ First Developer.
**Using conventional Process E-6 KODAK ™ Reversal Bath.
***Using conventional Process E-6 KODAK ™ Color Developer.
****Using conventional Process E-6 KODAK ™ Bleach.
#Using conventional Process E-6 KODAK ™ Fixer.
Using conventional Process E-6 KODAK ™ Final Rinse.

Various conditioning solutions were used in the noted process. Besides Examples 1–3, several Control solutions were used which are described in Table I below. All Control solutions contained no secondary amine, and Control A contained no formaldehyde precursor.

After the film samples were processed, they were evaluated by liquid chromatography to determine residual magenta color coupler in the element, and also in an accelerated keeping test (at 77° C. and 0% relative humidity) to determine the amount of magenta dye fade. The results of these tests are listed in Table I.

TABLE I

| Conditioning Solution | Formaldehyde Precursor Level (g/l) | Secondary Amine | Secondary Amine Level (g/l) | Residual Magenta Coupler (mg/l) | Magenta Dye Fade* |
|---|---|---|---|---|---|
| Control A | 0 | None | 0 | 111 | −30 |
| Control B | 60 | None | 0 | 0.2 | −1 |
| Control C | 50 | None | 0 | 13 | −1 |
| Control D | 40 | None | 0 | 25 | −5 |
| Control E | 30 | None | 0 | 41 | −24 |
| Control F | 20 | None | 0 | 66 | −21 |
| Control G | 10 | None | 0 | 63 | −26 |
| Control H | formalin check | None | 0 | None | −1 |
| Invention 1 | 10 | Morpholine | 1 | 2 | −1 |
| Invention 2 | 20 | Morpholine | 1 | 0.2 | −1 |
| Invention 3 | 30 | Morpholine | 1 | 0.3 | −1 |
| Invention 4 | 15 | Piperidine | 1 | <5 | −1 |
| Invention 5 | 15 | Diethanolamine | 1 | <5 | −1 |

*Density units of from a normal d(−logE) plot

The data show that when a formaldehyde precursor is used at a level above 40 g/l, without a secondary amine present, the dye fade is acceptable. That is, there is a loss of less than 3%. In the presence of a secondary amine, the level of formaldehyde precursor can be reduced to 30, and preferably, it can be reduced to 15 g/l or less. When the Example 1 conditioning solution was used, the amount of needed formaldehyde precursor was even less, that is, 15 g/l. With further optimization, one skilled in the art could readily find a useful secondary amine that could be used with as little as 10 g of formaldehyde precursor per liter of solution.

The invention has been described in detail with particular reference to preferred embodiments thereof, but it will be understood that variations and modifications can be effected within the spirit and scope of the invention.

We claim:

1. A method for processing a color silver halide photographic element comprising:

A) treating an imagewise exposed and developed color silver halide photographic element with a conditioning solution comprising a bleach accelerating agent, a formaldehyde precursor at a concentration of less than 30 g/l, and a secondary amine present in an amount of at least 0.05 g/l, provided that the weight ratio of said formaldehyde precursor to said secondary amine is at least 1:1, and B) bleaching said element treated in step A.

2. The method of claim 1 wherein said step A is carried out at from about 20° to about 40° C. for from about 30 to about 120 seconds.

3. The method of claim 1 wherein said bleach accelerating agent is a sulfur-containing organic compound.

4. The method of claim 3 wherein said bleach accelerating agent is an aliphatic thiol.

5. The method of claim 1 wherein said formaldehyde precursor is an N-methylol compound, sodium formaldehyde bisulfite or hexamethylenetetramine.

6. The method of claim 1 wherein said secondary amine is represented by the formula $$R^3—NH—R^4$$

wherein $R^3$ and $R^4$ are independently an alkyl group of 1 to 10 carbon atoms, a cycloalkyl group of 5 to 10 carbon atoms, an aryl group of 6 to 10 carbon atoms, a 5- to 10-membered heterocyclic group, or $R^3$ and $R^4$ together with the secondary amine moiety represent the atoms necessary to complete a 5- to 14-membered heterocyclic ring.

7. The method of claim 6 wherein said secondary amine is morpholine, piperidine, piperazine or diethanolamine.

8. The method of claim 1 wherein said formaldehyde precursor is present in step A in an amount of from about 5 to about 20 g/l, and said secondary amine is present in an amount of from about 0.05 to about 1.5 g/l.

9. The method of claim 8 wherein said formaldehyde precursor is present in step A in an amount of less than 15 g/l and said secondary amine is present in an amount of from about 0.1 to about 1.5 g/l.

10. The method of claim 1 for the processing of a color reversal film comprising treatment with a first development bath, a reversal bath and a color developer prior to step A, and treatment with a fixing bath and final wash after said bleaching step B.

11. The method of claim 1 wherein said color silver halide photographic element contains an arylpyrazolone magenta dye forming color coupler.

12. A conditioning solution having a pH of from about 4.5 to about 8, and comprising a bleach accelerating agent, a formaldehyde precursor at a concentration of less than 30 g/l, and a secondary amine present in an amount of at least 0.05 g/l, provided that the weight ratio of said formaldehyde precursor to said secondary amine is at least 1:1.

13. The solution of claim 12 wherein said bleach accelerating agent is an aliphatic thiol.

14. The solution of claim 12 wherein said formaldehyde precursor is an N-methylol compound, sodium formaldehyde bisulfite or hexamethylenetetramine.

15. The solution of claim 12 wherein said secondary amine is present in an amount of from about 0.05 to about 1.5 g/l, and is represented by the formula $$R^3—NH—R^4$$

wherein $R^3$ and $R^4$ are independently an alkyl group of 1 to 10 carbon atoms, a cycloalkyl group of 5 to 10 carbon atoms, an aryl group of 6 to 10 carbon atoms, and a 5- to 10-membered heterocyclic group, or $R^3$ and $R^4$ together with the secondary amine moiety represent the atoms necessary to complete a 5- to 14-membered heterocyclic ring.

16. The solution of claim 15 wherein said secondary amine is morpholine, piperidine, piperazine or diethanolamine.

17. The solution of claim 12 wherein said formaldehyde precursor is present in an amount of less than 20 g/l, and said secondary amine is morpholine, piperidine or diethanolamine.

18. The solution of claim 17 wherein said secondary amine is diethanolamine.

19. The solution of claim 12 wherein said formaldehyde precursor is present in step A in an amount of from about 5 to about 15 g/l, said secondary amine is present in an amount of from about 0.5 to about 1.25 g/l, and said solution has a pH of from about 4.5 to about 6.5.

20. A conditioning solution having a pH of from about 4.5 to about 6.5, and comprising a sulfur-containing organic bleach accelerating agent, a formaldehyde bisulfite in an amount of less than about 15 g/l, and a secondary amine that is morpholine, piperidine, piperazine or diethanolamine present in an amount of from about 0.5 to about 1.5 g/l, provided the weight ratio of formaldehyde precursor to said secondary amine is at least 1:1.

* * * * *